US009267239B2

(12) United States Patent
Dilkus

(10) Patent No.: US 9,267,239 B2
(45) Date of Patent: Feb. 23, 2016

(54) CREPING RELEASE AGENTS

(71) Applicant: Solenis Technologies, L.P., Schaffhausen (CH)

(72) Inventor: Christopher P Dilkus, Woodlynne, NJ (US)

(73) Assignee: Solenis Technologies, L.P. (CH)

( * ) Notice: Subject to any disclaimer, the term of this patent is extended or adjusted under 35 U.S.C. 154(b) by 0 days.

(21) Appl. No.: 14/640,654

(22) Filed: Mar. 6, 2015

(65) Prior Publication Data

US 2015/0176213 A1 Jun. 25, 2015

Related U.S. Application Data

(62) Division of application No. 13/153,988, filed on Jun. 6, 2011, now abandoned.

(60) Provisional application No. 61/352,192, filed on Jun. 7, 2010.

(51) Int. Cl.

| | |
|---|---|
| ***D21H 11/00*** | (2006.01) |
| ***D21H 21/14*** | (2006.01) |
| ***B31F 1/12*** | (2006.01) |
| ***D21H 17/35*** | (2006.01) |

(52) U.S. Cl.
CPC ..... *D21H 21/146* (2013.01); *B31F 1/12* (2013.01); *D21H 17/35* (2013.01)

(58) Field of Classification Search
CPC ..... D17H 17/35; D17H 21/146; B31F 1/12
See application file for complete search history.

(56) References Cited

U.S. PATENT DOCUMENTS

| | | | | |
|---|---|---|---|---|
| 3,326,835 A * | 6/1967 | Signorelli | ..... | C09D 191/00 524/488 |
| 6,139,911 A * | 10/2000 | Vanhecke | ..... | C10M 173/00 106/2 |
| 6,468,394 B1 * | 10/2002 | Sekiya | ..... | D21F 3/02 106/2 |

* cited by examiner

*Primary Examiner* — Peter D Mulcahy
(74) *Attorney, Agent, or Firm* — Joanne Rossi; Michael Herman

(57) ABSTRACT

Disclosed is a method of reducing adhesion to the surface of equipment used in paper manufacture or in paper converting processes, comprising applying to the surface the a composition. comprising (a) 50-98 parts of hydrocarbon oil, (b) 1-40 parts of emulsifier, and (c) 1-10 parts of a non-curing hydrocarbon polymer.

19 Claims, 1 Drawing Sheet

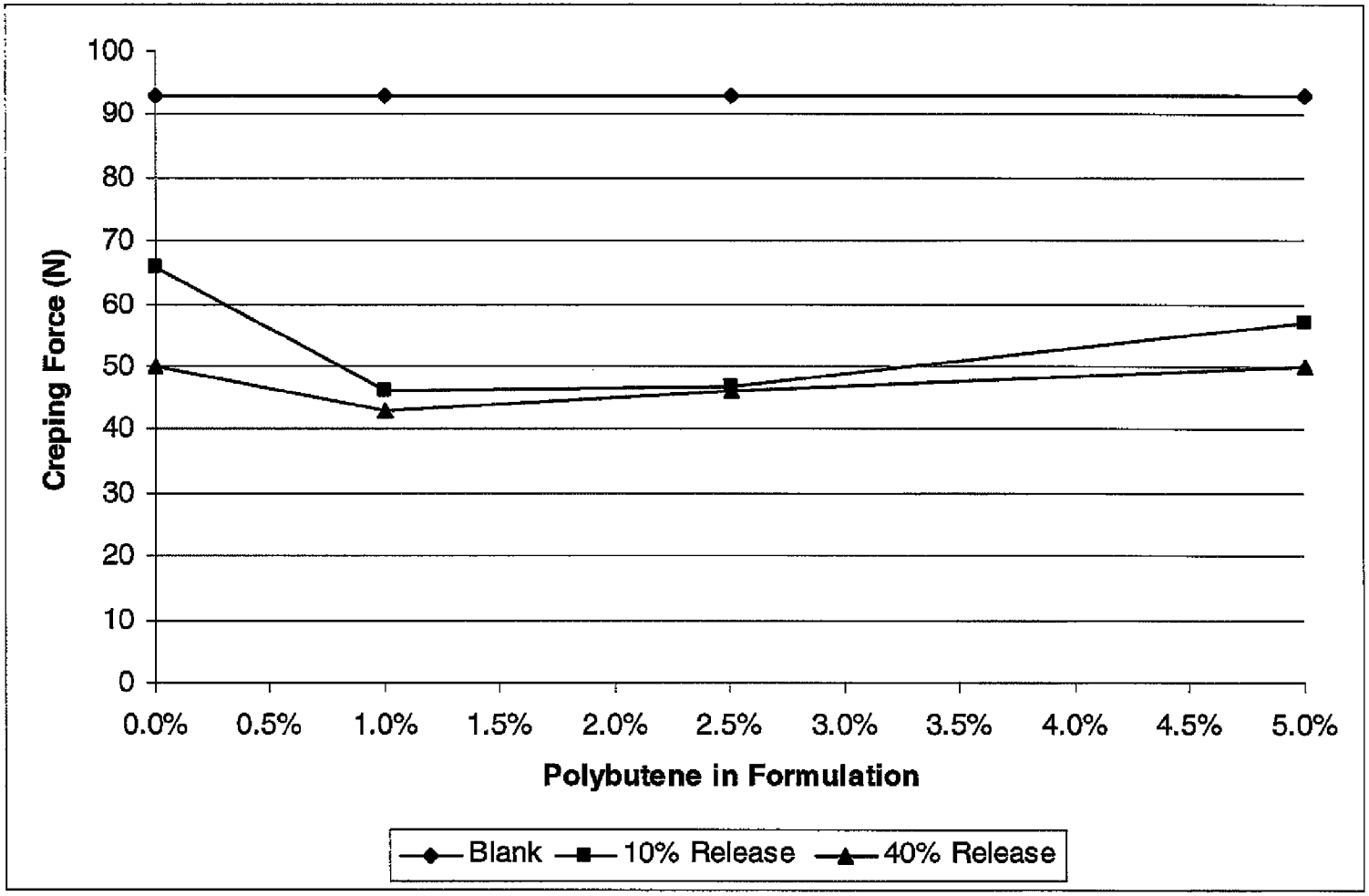
Creping Force (N)
100
90
80
70
60
50
40
30
20
10
0
0.0%
0.5%
1.0%
1.5%
2.0%
2.5%
3.0%
3.5%
4.0%
4.5%
5.0%
Polybutene in Formulation
Blank
10% Release
40% Release

CREPING RELEASE AGENTS

This application claims the benefit of U.S. patent application Ser. No. 13/153,988, filed Jun. 6, 2011, which claims the benefit of provisional application No. 61/352,192, filed Jun. 7, 2010, the entire contents of each are hereby incorporated by reference.

FIELD OF THE INVENTION

This invention relates to the creping of wet-laid paper products.

BACKGROUND OF THE INVENTION

In the manufacture of certain wet-laid paper products such as facial tissue, bathroom tissue, or paper towels, the paper web is conventionally subjected to a creping process in order to give it desirable textural characteristics, such as softness and bulk. The creping process typically involves adhering the web to a rotating creping cylinder, such as the apparatus known as a Yankee dryer, and then dislodging the adhered web with a doctor blade. The impact of the web against the doctor blade ruptures some of the fiber-to-fiber bonds within the web and causes the web to wrinkle or pucker.

The severity of this creping action is dependent upon a number of factors, including the degree of adhesion between the web and the surface of the creping cylinder. Greater adhesion causes increased softness, although generally with some loss of strength. In order to increase adhesion, an adhesive creping aid is used to enhance any naturally occurring adhesion that the web may have due to its water content, which will vary widely depending on the extent to which the web has been previously dried. Creping aids should also prevent wear of the dryer surface and provide lubrication between the doctor blade and the dryer surface and reduce chemical corrosion, as well as controlling the extent of creping. A coating that adheres the sheet to the drum will give a good crepe, imparting absorbance and softness with the least possible loss of paper strength. If adhesion to the dryer drum is too strong, the sheet may pick or even "plug", i.e., underride the doctor blade, and wrap around the dryer drum. If there is not enough adhesion, the sheet will lift off too easily and undergo too little creping. The creping adhesive, as an aqueous solution or dispersion, is usually sprayed onto the surface of the creping cylinder, e.g., a Yankee dryer. This adhesion of the sheet to the Yankee dryer improves heat transfer, allowing more efficient drying of the sheet.

If the web sticks too strongly to the creping cylinder, release agents can be sprayed on the cylinder. These release agents aid in the release of the tissue web at the creping blade, lubricate and protect the blade from excessive wear, and modify the properties of the adhesive allowing for control of coating thickness. Release agents may include materials such as emulsifiable oils, polyphosphates, and various surfactant-type chemistries. Release agents may be added to the wet end, blended with the adhesive and sprayed on the dryer using a single application system, or sprayed separately from the adhesive via a dedicated application system. The mode of action of release agents is such that they intentionally interfere with the formation of the coating. Typically, as the amount of release agent added is increased, the level of adhesion continues to decrease.

Certain hydrophobic chemicals, typically in the form of aqueous emulsions, are applied to paper machine equipment to act as release agents. For example, U.S. Pat. No. 5,658,374 to Glover teaches that an oil-in-water emulsion containing an alcohol, a fatty acid or an oil, and lecithin emulsified with a water-soluble or water-dispersible surfactant can be used to control sticky deposition on the surfaces of press rolls, yankee rolls and couch rolls surfaces in papermaking In another example, U.S. Pat. No. 5,863,385 to Siebott et. al. teaches a process for cleaning and preventing deposition on paper machine parts, including the press section, by treating the surface with an oil-in-water emulsion. The oil phase can be any of several compounds including saturated hydrocarbons, fatty alcohols, fatty acids, fatty acid esters, paraffin oil, mineral oil or poly-alpha-olefins. In another example, U.S. Pat. No. 6,139,911 to Vanhecke et. al. teaches the use of aqueous microemulsions for improving the release properties of press rolls where the oil phase is selected from oils, water insoluble surfactants, water insoluble polymers, and waxes. The microemulsion is applied by first diluting it with excess water or by applying it directly in the presence of excess water. When the microemulsion is applied to the press roll in either diluted manner, the emulsion breaks up, causing the release components to deposit on the roll surface as larger macroemulsion size (or greater) particles, which are more efficient at affecting release.

U.S. Pat. No. 6,558,513 to Pease et. al. teaches the use of non-curing hydrocarbon polymers, such as polybutene, for improving the release of paper webs from the surface of press rolls or other papermaking equipment or converting equipment. The composition is applied directly to the equipment surface in the absence of water, which would require application to an already cured creping adhesive coating and preclude its use in systems where the adhesive and release agents are blended and sprayed onto the dryer in a single application system. Further, these compositions contain, at minimum, 20% polybutene.

SUMMARY OF THE INVENTION

The present invention provides a method for improving paper web release from press rolls or other paper processing equipment by interfering with adhesive coating formation, providing additional lubrication between the doctor blade and the dryer surface, and altering the properties of the adhesive allowing for control of coating thickness and degree of adhesion. The inventor has found that, surprisingly, hydrocarbon oil based compositions containing a relatively small amount of a non-curing hydrocarbon polymer, such as polybutene, show greater release efficiency than those that contain no non-curing hydrocarbon polymer as well as those that contain a greater amount of a non-curing hydrocarbon polymer.

The method comprises applying to the equipment surface a composition comprised of (a) one or more emulsifiable hydrocarbon oils, (b) one or more emulsifiers, and (c) one or more non-curing hydrocarbon polymers. The non-curing hydrocarbon polymers used in the practice of this invention have the formula $$(CH_3)_3C\text{—}\left[C(R_1)(R_2)\text{—}C(R_3)(R_4)\right]_n\text{—}C(R_5)\text{=}C(CH_3)_2$$

or hydrogenates thereof, wherein $R_1$ through $R_5$ are hydrogen or —$CH_3$, with at least one of $R_1$ through $R_4$ being —$CH_3$; and n is a number such that the number average molecular weight of the hydrocarbon polymer is from 50 to 3000.

Preferred hydrocarbon oils are selected from white oils, mineral oils, or petroleum distillates, alone or in combination.

Preferred emulsifiers are selected from nonionic surfactants, anionic surfactants, and cationic surfactants, alone or in combination.

Preferred non-curing hydrocarbon polymers are isobutylene/butene copolymers (i.e. polybutenes) or hydrogenates thereof.

The compositions can be applied by any means, such as, blending with the adhesive and spraying on the dryer using a single application system, or spraying separately from the adhesive via a dedicated application system.

The composition of this invention also offers additional advantages. Polybutenes are known to be effective lubricants, therefore the compositions described in this invention are expected to provide an additional lubrication benefit to reduce creping and doctor blade wear. Polybutenes are found to be surprisingly effective release agents at relatively small portions, less than 10%, of the overall composition and are less costly than other potential release agents such as fluoropolymers and silicone oils.

Furthermore, the invention could be used on other equipment surfaces of papermaking or paper converting processes where enhancing release or increasing lubricity is of importance. Examples of such equipment surfaces include lumpbreaker rolls, couch rolls, uhle box covers, dryer cans, calendar rolls, corrugating fluting rolls, papermaking fabrics including those used in through air dryers, fabric carrier rolls, and printing presses.

BRIEF DESCRIPTION OF FIGURES

FIG. 1 is a graph illustrating the creping force as a function of polybutene in the formulation.

DETAILED DESCRIPTION OF THE INVENTION

On one aspect the invention provides a composition comprising (a) 50-98 parts of hydrocarbon oil, (b) 1-40 parts of emulsifier, and (c) 1-10 parts of a non-curing hydrocarbon polymer.

In another aspect the invention provides a method of reducing adhesion to a surface of equipment used in paper manufacture or in paper converting processes, said method characterized in applying to such surface a composition comprised of one or more emulsifiable hydrocarbon oils, one or more emulsifiers, and one or more non-curing hydrocarbon polymers.

The preferred hydrocarbon oils are selected from white oils, mineral oils, or petroleum distillates, alone or in combination. The preferred emulsifiers are selected from nonionic surfactants, anionic surfactants, cationic surfactants, alone or in combination. Preferred non-curing hydrocarbon polymers have the formula:

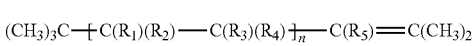

$$(CH_3)_3C-[C(R_1)(R_2)-C(R_3)(R_4)]_n-C(R_5)=C(CH_3)_2$$

or hydrogenates thereof, wherein $R_1$ through $R_5$ are hydrogen or $-CH_3$, with at least one of $R_1$ through $R_4$ being $-CH_3$; and n is a number such that the number average molecular weight of the hydrocarbon polymer is from 50 to 3000. Preferred non-curing hydrocarbon polymers are isobutylene/butene copolymers (i.e. polybutenes) or hydrogenates thereof.

In another aspect, the invention provides a method of reducing adhesion to a surface of equipment used in paper manufacture or in paper converting processes, said method characterized in applying to such surface a composition comprised of an emulsifiable hydrocarbon oil, an emulsifier, and one or more non-curing polybutenes resulting from isobutylene/butene copolymerization or hydrogenates thereof.

Although the formulations were made with polybutene in this invention, it is envisioned that the invention would also have utility in formulations made with polyethylene, polypropylene, and other similar hydrocarbon polymers.

Examples of hydrocarbon oils include, but are not limited to, Blandol® White Mineral Oil, (Sonnebom, Mahwah, N.J., USA) a white mineral oil; Hygold 100 (Ergon Refining, Jackson, Miss., USA), a naphthenic petroleum distillate; Sunpar®150, (Holly Corporation, Dallas, Tex., USA) a heavy paraffinic petroleum oil; and Unipar® 1000M, (UniSource Energy, West Chicago, Ill., USA) a solvent-refined paraffinic distillate.

Examples of emulsifiers include, but are not limited to, polyethylene glycol mono- and diesters of fatty acids; linear and branched alcohol ethoxylates; alkyl phenol ethoxylates; phosphate esters of linear and branched alcohol ethoxylates; and quaternary ammonium surfactants. The emulsifiers are present to reduce the interfacial tension at the oil-water interface and stabilize emulsions of the composition prior to and at the point of application.

Examples of non-curing polybutenes include, but are not limited to, Indopol®, (Ineos, League City, Tex., USA); and Dynapak Poly™ (Univar, Redmond, Wash., USA).

The invention comprises from 50 to 98 percent by weight of emulsifiable hydrocarbon oils; preferably from 62 to 97 percent.

The invention comprises from 1 to 40 percent by weight of emulsifiers, preferably from 2 to 30 percent, even more preferably from 5 to 25%; and from 1 to 10 percent by weight of a non-curing hydrocarbon polymer, preferably from 1 to 8 percent, even more preferably from 1 to 5.5 percent. The preferred non-curing hydrocarbon polymer is polybutene resulting from isobutylene/butene copolymerization or hydrogenates thereof.

One embodiment of the composition of the invention comprises: (a) from 50 to 98 percent by weight of emulsifiable hydrocarbon oils; (b) from 1 to 40 percent by weight of emulsifiers, and (c) from 1 to 10 percent by weight of a non-curing polybutene resulting from isobutylene/butene copolymerization or hydrogenates thereof. The number average molecular weight of the non-curing polybutene is from 50 to 3000.

Other additives such as polymeric dispersants could be included in small quantities to increase formulation stability.

EXAMPLES

The chemical compositions evaluated in the examples are described in Table 1. The surfactant used was a polyethylene glycol diester, PEG 400 DO. The polybutene was Indopol L-14.

TABLE 1

Chemical Compositions Used in Examples

| REFERENCE | DESCRIPTION |
|---|---|
| CA-1 | Crepetrol ® 5318 |
| RA-1 | 80.0% paraffinic oil, 20.0% nonionic surfactant |
| RA-2 | 79.2% paraffinic oil, 19.8% nonionic surfactant, 1% polybutene |
| RA-3 | 78% paraffinic oil, 19.5% nonionic surfactant, 2.5% polybutene |

TABLE 1-continued

| Chemical Compositions Used in Examples | |
|---|---|
| REFERENCE | DESCRIPTION |
| RA-4 | 76% paraffinic oil, 19% nonionic surfactant, 5% polybutene |

Example 1

The peel test simulates and measures the adhesion properties of an adhesive solution consisting of a combination of creping adhesive and release agent cured between a metal substrate and a fibrous material. A standard non-woven fabric is soaked in the solution and, once saturated, placed on a preheated metal panel and dried. The average force to peel away the strip from the plate was measured using a Zwick Z005 universal testing machine (Zwick GmbH & Co. KG, Ulm, Germany). The creping adhesive used, CA-1, was an aqueous solution of a cationic amine polymer-epichlorohydrin adduct Crepetrol 5318 (Hercules Incorporated, Wilmington, Del., USA). The benchmark release agent used, RA-1, is a surfactant in hydrocarbon solvent solution.

TABLE 2

| Peel Force | | |
|---|---|---|
| RELEASE | RELEASE ADDITION* | PEEL FORCE (N/cm) |
| none | — | 0.79 |
| RA-1 | 10% | 0.44 |
| RA-1 | 20% | 0.39 |
| RA-1 | 40% | 0.31 |
| RA-3 | 10% | 0.41 |
| RA-3 | 20% | 0.30 |
| RA-3 | 40% | 0.26 |

*Release addition given as wt % of the total coating package applied.

Table 2 shows that the addition of a relatively small amount of polybutene, in this case 2.5% by weight of the total composition of RA-3, yields a significant decrease in the peel force required to overcome the force of adhesion.

Example 2

The creping simulator test simulates and measures the force required to crepe a sheet of paper that has been adhered to a model Yankee. In use, an uncreped sheet is applied to a transfer roll and brought to the desired moisture content by spraying water on the sheet. An adhesive solution consisting of a combination of creping adhesive and release agent is sprayed onto a Yankee. After a controlled curing time, the transfer roll is pressed against the Yankee and the sheet is transferred to the Yankee. The Yankee rotation speed is increased to the desired creping speed. When it is at the correct creping speed, a crepe blade is brought into contact with the roll, and the force required to crepe the sheet from the roll is measured. The temperature of the Yankee and the crepe blade geometry can be varied to simulate a variety of machine conditions. The creping adhesive used, CA-1, was an aqueous solution of a cationic amine polymer-epichlorohydrin adduct, Crepetrol 5318 (Hercules Incorporated, Wilmington, Del., USA). The benchmark release agent used, RA-1, is a nonionic surfactant in hydrocarbon solvent solution.

TABLE 3

| Creping Force | | |
|---|---|---|
| RELEASE | RELEASE ADDITION* | CREPING FORCE (N) |
| none | — | 93 |
| RA-1 | 10% | 66 |
| RA-1 | 40% | 50 |
| RA-2 | 10% | 46 |
| RA-2 | 40% | 43 |
| RA-3 | 10% | 47 |
| RA-3 | 40% | 46 |
| RA-4 | 10% | 57 |
| RA-4 | 40% | 50 |

*Release addition given as wt % of the total coating package applied.

Table 3 shows that while the addition of a relatively small amount of polybutene, in this case 1.0% by weight of the total composition of RA-1, yields a significant decrease in the creping force measured at the creping blade, the addition of more polybutene to the composition actually yields a higher creping force.

The invention claimed is:

1. A method of reducing adhesion to a surface of equipment used in paper manufacture or in paper converting process comprising the steps of :

a) applying a composition comprising:
   (i) 50-98 weight percent of hydrocarbon oil,
   (ii) 1-40 weight percent of emulsifier, and
   (iii) 1-10 weight percent of a non-curing hydrocarbon polymer, to the surface of a creping cylinder,
b) pressing the paper web against the drying surface to adhere the web to the drying surface, and
c) dislodging the web from the drying surface with a creping device to crepe the paper web.

2. The method of claim 1 wherein at least one hydrocarbon oil is selected from the group consisting of white oils, mineral oils, petroleum distillates or combinations thereof.

3. The method of claim 1 wherein the non-curing hydrocarbon polymer comprises isobutylene/butene copolymers or hydrogenates thereof.

4. The method of claim 1 wherein the non-curing hydrocarbon polymer comprises polyethylene or polypropylene based copolymers.

5. The method of claim 1 wherein the non-curing hydrocarbon polymer has the formula

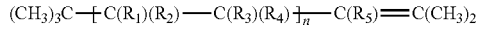

$$(CH_3)_3C-[C(R_1)(R_2)-C(R_3)(R_4)]_n-C(R_5)=C(CH_3)_2$$

or hydrogenates thereof, wherein $R_1$ through $R_5$ are hydrogen or $-CH_3$, with at least one of $R_1$ through $R_4$ being $-CH_3$, and n is a number such that the number average molecular weight of the hydrocarbon polymer is from 50 to 3000.

6. The method of claim 5 wherein the non-curing hydrocarbon polymer comprises a polybutene resulting from isobutylene/butene copolymerization or hydrogenates thereof.

7. The method of claim 6 wherein the composition contains less than about 8% polybutene.

8. The method of claim 1 wherein the non-curing hydrocarbon polymer comprises a polybutene resulting from isobutylene/butene copolymerization or hydrogenates thereof.

9. The method of claim 6 wherein the composition contains less than about 8% polybutene.

10. The method of claim 1 wherein the emulsifier is selected from the group consisting of polyethylene glycol mono- and diesters of fatty acids; alcohol ethoxylates; alkyl phenol ethoxylates; phosphate esters of alcohol ethoxylates; and quaternary ammonium surfactants.

11. The method of claim 1 wherein the weight percent of hydrocarbon oil is from 62 to 97 percent.

12. The method of claim 1 wherein the weight percent of emulsifiers is from 2 to 30 percent.

13. The method of claim 1 wherein the weight percent of non-curing hydrocarbon polymer is from 1 to 8 percent.

14. The method of claim 1 wherein the weight percent of non-curing hydrocarbon polymer is from 1 to 5.5 percent.

15. The method of claim 11 wherein the weight percent of emulsifiers is from 2 to 30 percent and wherein the weight percent of non-curing hydrocarbon polymer is from 1 to 8 percent.

16. The method of claim 3 wherein the weight percent of hydrocarbon oil is from 62 to 97 percent.

17. The method of claim 3 wherein the weight percent of emulsifiers is from 2 to 30 percent.

18. The method of claim 3 wherein the weight percent of non-curing hydrocarbon polymer is from 1 to 8 percent.

19. The method of claim 1 wherein the composition is applied by splaying the composition onto the surface of the equipment used in paper manufacture or in paper converting process.

* * * * *